United States Patent [19]

Pernick

[11] Patent Number: 4,916,925

[45] Date of Patent: Apr. 17, 1990

[54] NEEDLE LATCH CUSHIONING MEMBER FOR CIRCULAR KNITTING MACHINES

[75] Inventor: Bruce M. Pernick, Glendale, N.Y.

[73] Assignee: Monarch Knitting Machinery Corporation, Glendale, N.Y.

[21] Appl. No.: 264,813

[22] Filed: Oct. 31, 1988

[51] Int. Cl.[4] ..... D04B 15/58; D04B 15/08

[52] U.S. Cl. ..... 66/141; 66/111

[58] Field of Search ..... 66/111, 136, 141, 142

[56] References Cited

U.S. PATENT DOCUMENTS

| | | | |
|---|---|---|---|
| 2,214,706 | 9/1940 | Holmes | 66/111 |
| 2,425,243 | 8/1947 | Holmes et al. | 66/136 |
| 2,495,543 | 1/1950 | Peberdy | 66/111 |
| 3,050,968 | 8/1962 | Masujima | 66/121 |
| 3,916,650 | 11/1975 | Schmidt et al. | 66/111 |
| 4,441,339 | 4/1984 | Yorisue | 66/111 |

FOREIGN PATENT DOCUMENTS

| | | | |
|---|---|---|---|
| 2344157 | 3/1975 | Fed. Rep. of Germany | 66/111 |
| 408598 | 4/1934 | United Kingdom | 66/136 |

*Primary Examiner*—Wm. Carter Reynolds

*Attorney, Agent, or Firm*—Bell, Seltzer, Park & Gibson

[57] ABSTRACT

The needle latch cushioning member is formed of resilient material and includes an elongate body portion with a free end portion. The elongate body portion is supported in a groove on a yarn feed finger so that the free end portion is positioned to be engaged by and interrupt the swinging movement of the latches of the needles to the closed position as the needles are lowered to stitch loop forming position. The engagement of the latches of the needles with the free end portion of the resilient cushioning member serves to reduce the impact force of the latches against the hooks of the needles and thereby increases the wear life of the needles, without interfering with the feeding of the yarn into the hooks of the needles. When properly positioned, the free end of the resilient cushioning member can be used to guide the yarn into the hooks of the needles.

12 Claims, 2 Drawing Sheets

NEEDLE LATCH CUSHIONING MEMBER FOR CIRCULAR KNITTING MACHINES

FIELD OF THE INVENTION

This invention relates generally to a needle latch cushioning member for circular knitting machines, and more particularly to a needle latch cushioning member for resiliently interrupting the swinging movement of the needle latches to thereby reduce the impact of the latches against the body of the needle so that the wear life of the needles is increased.

BACKGROUND OF THE INVENTION

It is generally known to provide a metallic rod or plate member on a circular double cylinder knitting machine for temporarily retarding or detaining the swinging movement of the needle latch to improve the plating of yarns during the formation of stitch loops. For example, Holmes et al U.S. Pat. No. 2,425,243 discloses such an arrangement in which a latch detainer plate is mounted for pivotal movement into and out of operative positions. When the latch detainer plate is in the operative position, the inner end of the horizontally disposed latch detaining plate is positioned so that its lower surface is engaged by the latches of the needles in the lower cylinder as they are being drawn downwardly to stitch forming position and its upper surface is engaged by the latches of the needles in the upper cylinder as they are being raised to stitch loop forming position. The latch detainer plate is controlled so that it is moved into operative position when the plating yarn feed finger is activated and the latch detainer plate is moved to the inoperative position when the plating yarn feed finger is moved to the inactive position.

A similar type of latch retarding device is disclosed in the Peberdy U.S. Pat. No. 2,495,543. The latch retarding device of this patent includes a metallic rod with a horizontally disposed flattened free end which is supported for movement between active and inactive positions. When moved to the active position, the lower portion of the flattened free end of the latch detaining member is engaged by the closing latches of the needles of the lower cylinder which are being lowered to a stitch forming position while the upper surface of the flattened free end portion of the latch detaining member is engaged by the closing latches of the needles in the upper cylinder as they are being raised to a stitch forming position. The latches are free to move to their fully closed position after they pass off of the free end of the flattened free end portion of the latch retarding device. The retarding of the movement of the latch to the closed position is provided for the purpose of enhancing the plating of yarns fed to the needles in the formation of rib fabric.

During present day high speed knitting on circular knitting machines the needles become worn to the place that they must be replaced within about three to twelve weeks of operation of the knitting machine. In many cases the failure of the needles is caused by the free end of the latch engaging the hook of the needle when the latch swings to the closed position during the movement of the needle to a lowered stitch loop forming position. The tip or spoon end of the latch engages the hook of the needle with a high impact force as the previously formed stitch loop swings the latch to the closed position as the loop rides up the needle and is shed therefrom. Needle wear is pronounced when open end spun cotton yarns are knit because many of these yarns include various types of contaminents, such as particles of silica which act as an abrasive when metal to metal contact is made between the spoon or tip of the latch and the end of the needle hook. Wear of the needle also occurs when the latch swings to the fully open position as the needle is raised to clear the stitch loop below the latch. In some cases the impact forces of the latch against the needle causes metal fatigue and latch failure.

The latch retarding or detaining devices disclosed in the above-identified patents are not satisfactory for use in cushioning the impact of the latch against the hook in present day high speed circular knitting machines because these devices are formed of metal and are not sufficiently resilient to momentarily interrupt and cushion the swinging movement of the latches during the final portion of the swinging movement. Also, the metallic latch detaining or retarding devices disclosed in these patents may cause undesirable wear of the latches.

SUMMARY OF THE INVENTION

With the foregoing in mind, it is an object of the present invention to provide a needle latch cushioning member which is formed of resilient material and supported in a position to be engaged by the latches of the needles during the final portion of the swinging movement to thereby resiliently interrupt the movement of the latches and to reduce the impact force of the latches against the needles so that the wear life of the needles is increased.

The two embodiments of the resilient cushioning member of the present invention are illustrated as being supported in position to be engaged by the latches during the final portion of their swinging movement to the closed position, when the needles are being lowered to the stitch loop forming level. The resilient cushioning member does not interfere with the feeding of the yarn and is positioned to help guide the yarn into the hook of the needle.

In accordance with each embodiment of the present invention, the resilient cushioning member includes an elongate body portion with a free end portion. The elongate body portion is supported so that the free end portion is maintained in position to be successively engaged by the latches of the needles as the latches swing toward the closed position to resiliently interrupt the movement of the latches to the closed position and to thereby reduce the impact force of the latches against the hooks of the needles. The elongate body portion of the resilient cushioning member is supported on a yarn feed finger positioned adjacent the location at which the needles are lowered to the stitch forming position. The resilient cushioning member can also be supported on other parts of the knitting machine.

In the first embodiment, the free end portion of the resilient cushioning member is tapered to a point and is curved inwardly and positioned so as to not interfere with the normal feeding of the yarn into the hooks of the needles as they are lowered to stitch forming position. The elongate body portion of the resilient cushioning member is positioned in a groove formed in the yarn feed finger and is maintained in the groove by means of a screw and washer so that the resilient cushioning member can be easily removed and replaced when it becomes worn. The groove in the yarn feed finger extends downwardly at an angle which corresponds with the downward angle of travel of the needles as they are being lowered to stitch loop forming position. The mounting of the elongate body portion of the resilient cushioning member in the angularly disposed groove of the yarn feed finger also provides for easy adjustment of the position of the pointed end of the free end portion relative to the downward angular path of movement of the hooks of the needles as they are lowered to stitch loop forming position.

The groove, in which the elongate body portion of the resilient cushioning member is supported in the yarn feed finger, faces outwardly of the needle cylinder to provide easy access for removing and replacing the resilient cushioning member, or adjustment thereof. The resilient cushioning member is formed of a plastic or rubber-like material with the elongate body portion being square in cross section so that it may be easily retained in the groove in the yarn feed finger by the washer and screw.

In the second embodiment, the resilient cushioning member is substantially straight and is supported in an angularly disposed groove formed in the bottom face of the yarn feed finger. The free end of the resilient cushioning member is positioned to be successively engaged by the latches of the needles as the latches swing toward the closed position to resiliently interrupt the movement of the latches to the closed position. The resilient cushioning member is maintained in adjusted position in the groove in the bottom face of the yarn feed finger by an inwardly turned lower edge of a clamping plate maintained in position against the outer face of the yarn feed finger.

BRIEF DESCRIPTION OF THE DRAWINGS

Other objects and advantages will appear as the description proceeds when taken in connection with the accompanying drawings, in which.

DESCRIPTION OF THE FIRST EMBODIMENT

Figure 1:
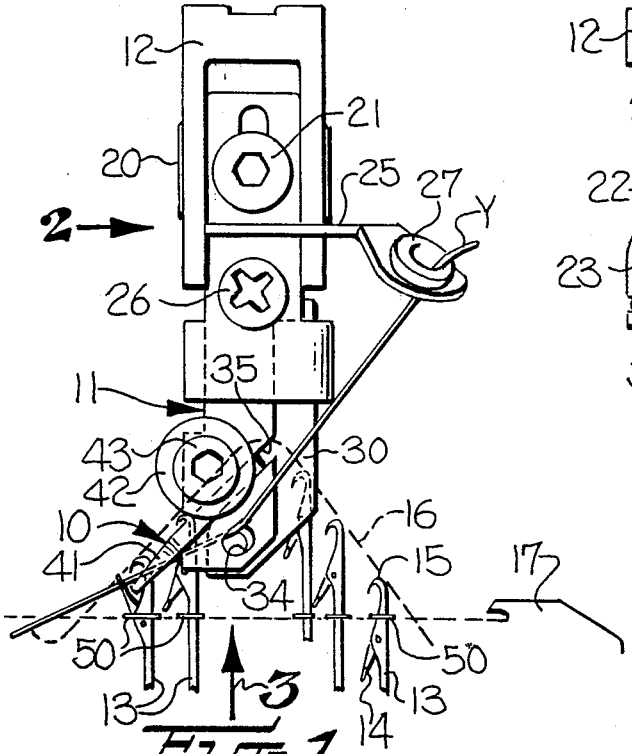
FIG. 1 is a fragmentary elevational view of a yarn feed finger and illustrating the manner in which the first form of resilient cushioning member is supported thereby in relationship to the path of travel of the needles as they are raised and then lowered to stitch loop forming position at a knitting station.

In FIGS. 1–4, the first form of resilient cushioning member of the present invention, broadly indicated at 10, is illustrated as being supported on a conventional yarn feed finger, broadly indicated at 11, of a circular knitting machine. The upper end portion of the yarn feed finger 11 is supported on a pivot bracket 12 so that its lower end is positioned adjacent and outside of a circle of latch needles 13 including pivoted latches 14 and upper hooks 15. The latch needles 13 are supported for vertical movement in the usual manner in a rotatable needle cylinder, not shown, and conventional cams are provided to raise the needles 13 as they move past the yarn feed finger 11 and then lower the same to stitch loop forming position as they move from right to left in FIG. 1, and along a pathway indicated by a dotted line 16. Sinkers 17 are supported for movement between the needles 13 in the usual manner. The yarn feed finger 11 is of the general type shown in U.S. Pat. No. 4,441,339. However, it is to be understood that the resilient cushioning member 10 of the present invention could be supported on other conventional types of yarn feeding fingers, or on other parts of the knitting machine.

The upper end portion of the yarn feed finger 11 is supported for limited pivotal movement on a pivot shaft 20 by means of a set screw 21 which extends through an elongated slot in the upper end of the feed finger 11 to provide vertical adjustment to the feed finger 11. The pivot shaft 20 is provided with a flat inner portion which is engaged by the upper end of a spring member 22. The lower end portion of the spring 22 extends around a pin 23 and its lower end is anchored on the pivot bracket 12. The leaf spring member 22 urges the lower end of the feed finger 11 in a counterclockwise direction in FIG. 2 against a transverse stop pin 24 so that the feed finger 11 is normally maintained in the vertical position shown. Should one or more needles engage the lower end of the feed finger 11, it will be resiliently urged outwardly to prevent damage to the needles and a jam-up of the knitting machine. A yarn guide bracket 25 is fixed at its inner end to the medial portion of the feed finger 11 by a screw 26 and the outer free end thereof is provided with a yarn guide eye 27 through which yarn Y is fed from a yarn supply source, not shown.

Figure 4:
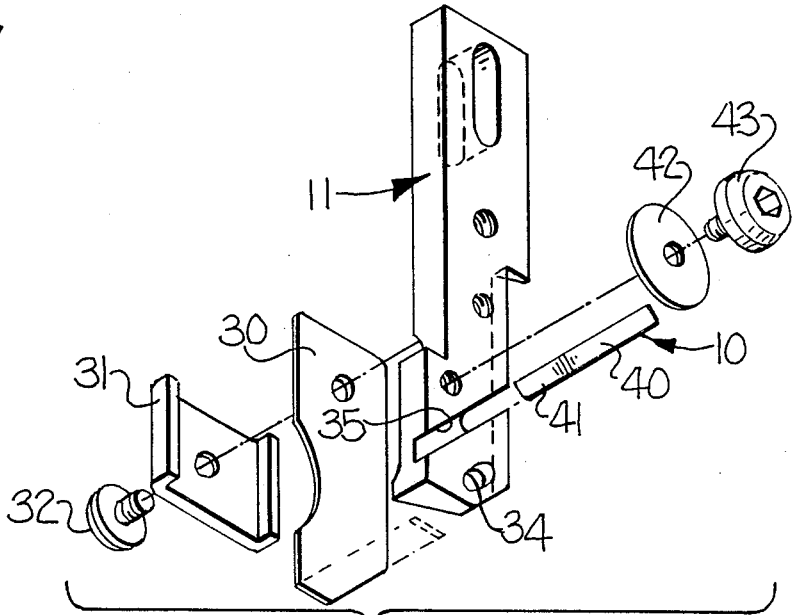
FIG. 4 is an exploded isometric view of the yarn feed finger and the resilient cushioning member.

A latch guard plate 30 extends downwardly inside of the yarn feed finger 11 and is maintained in fixed relationship at its upper end by a clamp plate 31 and a screw 32 (FIG. 4). The lower end of the yarn feed finger 11 is provided with an angularly disposed yarn guide opening 34 through which the yarn Y passes during its path of travel into the hooks of the needles 13 as they are being lowered to a stitch loop forming position.

Figure 3:
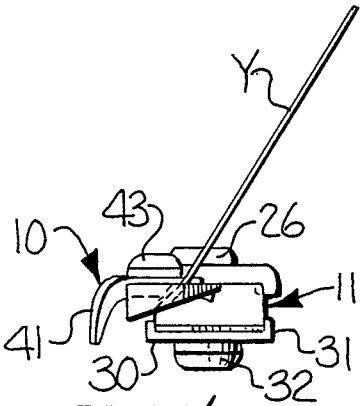
FIG. 3 is a bottom plan view looking upwardly at the lower end of the yarn feed finger and illustrating the position of the resilient cushioning member supported thereby.

In order to accommodate the resilient cushioning member 10, the lower portion of the outer face of the feed finger 11 is provided with an angularly extending groove 35 (FIG. 4). The groove 35 extends downwardly at an angle which corresponds with the downward angle of travel of the hooks 15 of the needles 13 as they are being lowered to stitch loop forming position (FIG. 1). The resilient cushioning member 10 includes an elongate body portion 40 which is square in cross section and is curved inwardly toward the circle of needles 13 to provide a free end portion 41. As illustrated in FIG. 3, the outer and inner surfaces of the free end portion 41 taper inwardly toward each other to substantially a point at the tip of the free end portion 41. The free end portion 41 extends inwardly at substantially a right angle from the elongate body portion 40. As shown in FIG. 1, the tip of the free end portion 41 is positioned just below the yarn Y to help guide the yarn into the hook 15 of the needle 13 as it is lowered.

The elongate body portion 40 is supported in the groove 35 for easy removal and replacement, as well as for adjustment, by means of a washer 42 and a screw 43. The square elongate body portion 40 of the resilient cushioning member 10 is of substantially the same width as the groove 35 in the yarn feed finger 11 so that the body portion 40 can be easily placed into the groove 35. The thickness of the elongate body portion 40 is slightly greater than the depth of the groove 35. When the elongate body portion 40 is positioned in the groove 35, the washer 42 overlies the outer portion of the elongate body portion 40 and resiliently engages and slightly compresses the same when the screw 43 is tightened (FIG. 1) to maintain the resilient cushioning member 10 in adjusted position in the groove 35. Since the screw 42 faces outwardly of the needle cylinder, it is easily accessible for an operator to loosen or remove the screw 42 in order to either replace or adjust the position of the resilient cushioning member 10.

METHOD OF OPERATION

As the needles 13 pass each of the knitting stations, they are successively raised and lowered, as indicated by the dotted line 16 in FIG. 1, so that the previously formed loops, indicated at 50, initially move the latches 14 to the open position as the needles are raised to pick up the yarn Y in the hooks 15. The needles 13 are shown in side elevation in FIG. 1 so that the position of the latches 14 is shown. However, the needles 13 are normally positioned with the hooks 15 and latches 14 facing away from the observer. The previously formed loops 50 then swing the latches 14 to the closed position as the needles are lowered to stitch loop forming position.

Figure 2:
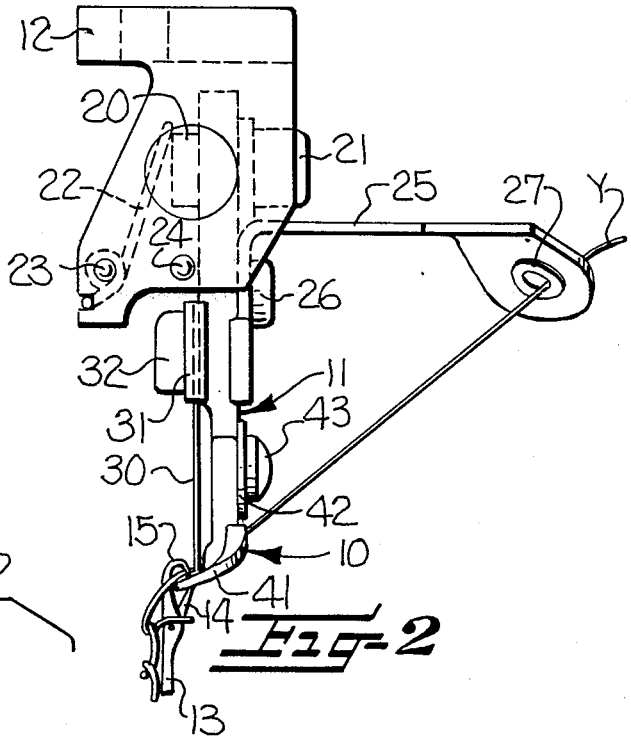
FIG. 2 is a side elevational view looking at the left-hand side of FIG. 1, in the direction of the arrow 2.

Just before the latch 14 moves to the closed position to engage the hook 15, as illustrated in FIG. 2, the latch 14 engages the tip end portion of the free end portion 41 of the resilient cushioning member 10 to thereby momentarily interrupt the swinging movement of the latches 14 to the closed position, and without interfering with the feeding of the yarn Y into the hooks 15 of the needles 13. The engagement of the latch 14 with the resilient cushioning member 10 reduces the normal impact force of the latch 14 against the hook 15 of the needle 13 to thereby reduce wear and to increase the wear life of the needles. As the needle moves beyond the tip end of the free end portion 41, the latch 14 continues its swinging movement to the closed position as a new stitch loop is formed and the previously formed stitch loop 50 i shed over the top of the needle.

As has been described, the position of the resilient cushioning member 10 can be adjusted by loosening the screw 43 and sliding the cushioning member 10 upwardly or downwardly in the groove 35. The screw 43 may then be retightened after the proper adjustment has been made. As will be noted, the slope of the groove 35 corresponds to the downward angle at which the needles travel when moving from their uppermost position to the lower stitch loop forming position so that the moment of impact of the latches can be adjusted to various points along the downward path of travel of the needles while the latch is swinging to its closed position. The resilient cushioning member 10 can be formed of various types of plastic material, such as polyurethane, polypropylene, or the like. The resilient cushioning member 10 can also be formed of rubber-like material, such as polybutadiene, nitrite, or the like.

Thus, the resilient cushioning member 10 operates to momentarily interrupt and dampen the swinging movement of the latches to the closed position as the needles are lowered so that the impact of the latches against the hooks of the needles is dampened and reduced, resulting in an increased wear life for the needles. It has been found that the wear life of the needles can be increased by the use of the resilient cushioning member of the present invention from the normal three to twelve weeks period to a period of three to six months.

DESCRIPTION OF THE SECOND EMBODIMENT

The second form of resilient cushioning member is illustrated in FIGS. 5–8 and is very similar to the first form of resilient cushioning member illustrated in FIGS. 1–4. The parts of the second form of resilient cushioning member will bear the same reference characters as the corresponding parts of the first form of resilient cushioning member, with the prime notation added.

The second form of resilient cushioning member, broadly indicated at 10', is illustrated as being supported on the lower end of a yarn feed finger, broadly indicated at 11', of a circular knitting machine. The upper end portion of the yarn feed finger 11' is suitably supported on the circular knitting machine so that its lower end is positioned adjacent and outside of a circle of needles 13' including pivoted latches 14' and upper hooks 15'. The latch needles 13' are supported for vertical movement in the usual manner in a rotatable needle cylinder, not shown, and conventional cams are provided to raise the needles 13' as they move past the yarn feed finger 11' and then lower the same to stitch loop forming position as they move from right to left in FIG. 5, and along a pathway indicated by a dotted line 16'. Sinkers 17' are supported for radial inward and outward movement between the needles 13' during the formation of stitch loops, in the usual manner.

The yarn feed finger 11' is supported on the knitting machine for vertical adjustment, for purposes to be presently described. Vertical adjustment of the yarn feed finger 11' can be accomplished by an elongate mounting slot 18 formed in the upper end portion. A screw, not shown, is adapted to pass through the slot 18 and holds the yarn feed finger 11' in vertically adjusted position against any suitable fixed part of the knitting machine.

Figure 5:
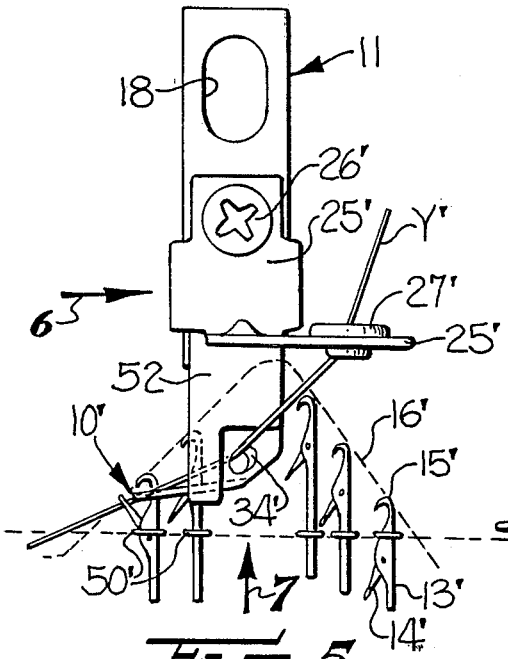
FIGS. 5–8 are views similar to the corresponding FIGS. 1–4 but illustrating the second form of resilient cushioning member supported on another type of yarn feed finger.
Figure 7:
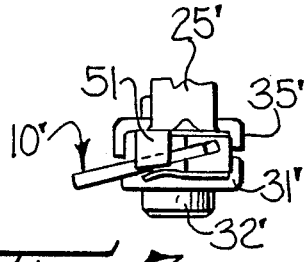
Figure 8:
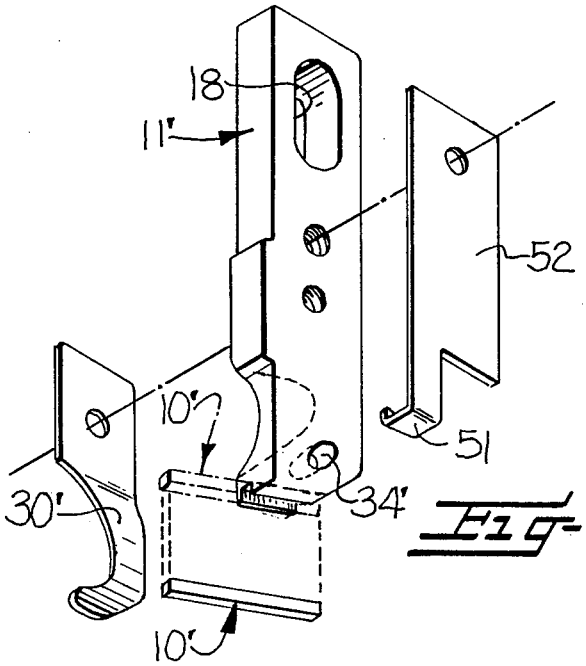

A yarn guide bracket 25' is fixed at its inner end to the medial portion of the outer face of the yarn feed finger 11' by a screw 26'. The outer free end of the yarn guide bracket 25 is provided with a yarn guide eye 27' through which yarn Y' is fed from a yarn supply source, not shown. A latch guard plate 30' extends downwardly adjacent the inner face of the yarn feed finger 11' and is maintained in fixed relationship at its upper end by a clamp plate 31' and a screw 32' (FIG. 7). The lower end of the yarn feed finger 11' is provided with an angularly disposed yarn guide opening 34' through which the yarn Y' passes during its path of travel into the hooks 15' of the needles 13' as they are being lowered to a stitch loop forming position, as illustrated in FIG. 5.

In order to accommodate the resilient cushioning member 10', the lower or bottom face of the feed finger 11' is provided with an angularly extending groove 35'. The groove 35' extends at slight downwardly and inwardly angles so that the outer free end of the resilient cushioning member 10' is positioned to be engaged by the latch 14' as each successive needle 13' is being lowered to stitch loop forming position, as illustrated in FIG. 5.

The elongate body portion of the resilient cushioning member 10' is supported in the angular groove 35' for easy removal and replacement, as well as for inward and outward adjustment, by means of an inwardly turned lower edge portion 51 of a vertically extending clamping plate 52. The clamping plate 52 extends upwardly along the outer face of the yarn feed finger 11' and is held in position by the screw 26', at the upper end portion thereof. The screw 26' preferably extends through an elongated slot, not shown, in the upper end of the clamping plate 52 so that the clamping plate 52 may be lowered to release the resilient cushioning member 10' when an adjustment is to be made or when the resilient cushioning member 10' is to be removed and replaced. The clamping plate 52 is then raised so that the lower inwardly turned lower edge portion 51 engages and maintains the resilient cushioning member 10' in the groove 35'.

The second form of resilient cushioning member 10' operates in the same manner as the first form of resilient cushioning member 10. Thus, as the needles 13' pass each of the knitting stations, they are successively raised and lowered, as indicated by the dotted line 16' in FIG. 5, so that the previously formed loops 50' initially move the latches 14' to the open position as the needles are raised to pick up the yarn Y' in the hooks 15'. The needles 13' are then lowered so that the previously formed loops 50' swing the latches 14' to the closed position as the needles are lowered to stitch loop forming position.

Figure 6:
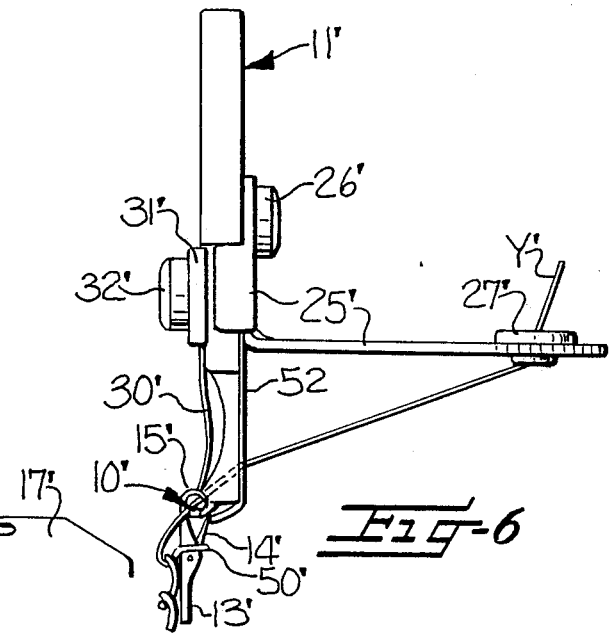

Just before the latch 14' moves to the fully closed position to engage the hook 15', as illustrated in FIGS. 4, 5 and 6, the latch 14' engages the tip end portion of the free end of the resilient cushioning member 10' to thereby momentarily interrupt the swinging movement of the latch 14' to the closed position, without interfering with the feeding of the yarn Y' into the hooks 15' of the needles 13'. Since the free end of the resilient cushioning member 10' is positioned just below the level of the yarn Y' (FIG. 5), the resilient cushioning member 10' helps to feed the yarn into the hook 15' as the needle 13' is being lowered. The engagement of the latch 14' with the resilient cushioning member 10' reduces the normal impact force of the latch 14' against the hook 15' of the needle 13' to thereby reduce wear and to increase the wear life of the needles. As each needle 13' moves beyond the tip of the free end of the resilient cushioning member 10', the latch 14' continues its swinging movement to the closed position as a new stitch loop is formed and the previously formed loop 50' is shed over the top of the needle.

The second form of resilient cushioning member 10' is also formed of a plastic or rubber-like material of the same type as that described for forming the first form of resilient cushioning member 10. The exact latch engaging position of the resilient cushioning member 10' can be easily adjusted by raising or lowering the yarn feed finger 11' and by moving the resilient cushioning member 10' inwardly and outwardly in the groove 35'. This second form of resilient cushioning member 10' can be easily adjusted to cushion the impact of needles with short latches.

Each embodiment of the present resilient cushioning member is illustrated and described as being supported on a yarn feed finger and positioned to reduce the impact force of the latch as it closes when the needle is being lowered to the stitch loop forming position. However, it is to be understood that the present latch cushioning member can also be supported on other parts of the knitting machine and positioned to reduce the impact force of the latch as it swings to the open position when the needle is being raised and the latch is swinging to the open position. In this case, the free end portion of the resilient cushioning member will be engaged by the outer surface of the latch just prior to the latch engaging the seat in the body of the needle at the lower end of the latch pivot slot. The elongate body of the resilient cushioning member is illustrated as being square in cross section but can be of any suitable cross sectional configuration.

Each embodiment of the resilient cushioning member is supported for adjustment so that the free end portion is positioned inside of the needle hook as the needle is being drawn downwardly to stitch loop forming position. The positioning of the free end portion of the resilient cushioning member in the hook of the needle substantially corresponds with the location where the yarn moves into the hook of the needle with the free end portion just below the level of the yarn. In this position, the free end portion of the resilient cushioning member does not interfere with the feeding of the yarn into the hook of the needle. In fact, the free end portion of the resilient cushioning member can be positioned to act as a guide and to thereby direct the yarn into the hook so that the closing latch does not have to serve this function. Since the resilient cushioning member can be positioned to guide the yarn into the needle hook, it is possible to knit certain types of yarn while a very small amount of tension is being applied thereto.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. In a circular knitting machine including a circle of latch needles supported for vertical movement in a rotatable needle cylinder, a yarn feed finger adjacent said rotatable needle cylinder and including a yarn feeding passageway for feeding yarn into the hooks of successive needles as the needles are raised and move past the yarn feed finger and then lowered to form stitch loops of the yarn fed into the hooks thereof, and wherein the latches swing to an open position as the needles are raised and then swing to a closed position as the needles are lowered, the combination therewith of latch cushioning means for momentarily interrupting the swinging movement of the latches during the final portion of the swinging movement and to thereby increase the wear life of the needles, said latch cushioning means comprising (a) a resilient member including an elongate body portion and a free end portion, and (b) means supporting said elongate body portion of said resilient member on said yarn feed finger with said free end portion maintained in a fixed position to be successively engaged by the latches of the needles during the final portion of the swinging movement to resiliently interrupt the movement of the latches and to thereby reduce the impact force of the latches against the needles.

2. In a circular knitting machine including a circle of latch needles supported for vertical movement in a rotatable needle cylinder, a yarn feed finger adjacent said rotatable needle cylinder and including a yarn feeding passageway for feeding yarn into the hooks of successive needles as the needles are raised and move past the yarn feed finger and then lowered to form stitch loops of the yarn fed into the hooks thereof, and wherein the latches swing to an open position as the needles are raised and then swing to a closed position as the needles are lowered, the combination therewith of latch cushioning means for interrupting the swinging movement of the latches to the closed position as the needles are lowered and to thereby increase the wear life of the needles, said latch cushioning means comprising (a) a resilient member including an elongate body portion and a free end portion, and (b) means supporting said elongate body portion of said resilient member on said yarn feed finger with said free end portion maintained in a fixed position to be successively engaged by the latches of the needles as the latches swing toward the closed position to resiliently interrupt the movement of the latches to the closed position and to thereby reduce the impact of the latches against the hooks of the needles.

3. Latch cushioning means according to claim 2 wherein said means supporting said elongate body portion of said resilient member includes a groove in said yarn feed finger adapted to receive said elongate body portion, and means for maintaining said elongate body portion in adjusted position in said groove.

4. Latch cushioning means according to claim 3 wherein said yarn feed finger includes an outer face, and wherein said groove is formed in said outer face of said yarn feed finger.

5. Latch cushioning means according to claim 3 wherein said needles are successively lowered along a predetermined angular path of travel as they move past said yarn feed finger, and wherein said groove in said yarn feed finger is positioned at an angle corresponding to the downward angle of movement of travel of the needles as they are lowered to permit adjustment of the point of contact of the free end portion of said resilient member with said latches as they are swinging to the closed position.

6. Latch cushioning means according to claim 3 including a screw removably supported in said yarn feed finger and adjacent said groove, and a washer maintained in position by said screw and having a portion overlying said groove and said elongate body portion supported in said groove.

7. Latch closing means according to claim 6 wherein said elongate body portion of said resilient member is substantially square in cross section and is of substantially the same width as said groove in said yarn feed finger, and wherein the thickness of said elongate body portion is slightly greater than the depth of said groove so that said washer engages and slightly compresses said elongate body portion when said screw is tightened to maintain said resilient cushioning member in adjusted position in said groove.

8. Latch cushioning means according to claim 2 wherein said free end portion of said resilient cushioning member curves inwardly from said elongate body portion and terminates at a position inside of said yarn feed finger and in a position to be engaged by the closing latch of the needle.

9. Latch cushioning means according to claim 8 wherein said free end portion of said resilient member extends inwardly at substantially a right angle to said elongate body portion.

10. Latch cushioning means according to claim 3 wherein said yarn feed finger includes a bottom face, and wherein said groove is formed in said bottom face.

11. Latch cushioning means according to claim 10 wherein said groove is inclined downwardly and inwardly, and wherein said resilient cushioning member is substantially straight and includes a free end positioned to be engaged by the closing latch of the needle.

12. Latch cushioning means according to claim 11 wherein said yarn feed finger includes an outer face, and wherein said means for maintaining said resilient cushioning member in said groove comprises a clamping plate fixed to said outer face of said yarn feed finger, and an inwardly turned lower edge portion on said clamping plate, said inwardly turned lower edge portion extending over said groove and maintaining said resilient cushioning member in said groove.

* * * * *